US005306524A

United States Patent [19]

Rutz et al.

[11] Patent Number: 5,306,524

[45] Date of Patent: Apr. 26, 1994

[54] THERMOPLASTIC COATED MAGNETIC POWDER COMPOSITIONS AND METHODS OF MAKING SAME

[75] Inventors: Howard G. Rutz, Newtown, Pa.; Christopher Oliver, Burlington; Brooks Quin, Marlton, both of N.J.

[73] Assignee: Hoeganaes Corporation, Riverton, N.J.

[21] Appl. No.: 945,166

[22] Filed: Sep. 15, 1992

Related U.S. Application Data

[60] Division of Ser. No. 701,776, May 17, 1991, Pat. No. 5,198,137, which is a continuation-in-part of Ser. No. 365,186, Jun. 12, 1989, Pat. No. 5,063,011.

[51] Int. Cl.[5] ..... B05D 7/00

[52] U.S. Cl. ..... 427/216; 148/105; 148/257; 264/126; 264/319; 427/221

[58] Field of Search ..... 75/230, 232, 234, 235, 75/246; 148/104, 306, 105, 257; 252/62.54; 427/216, 213, 221; 428/407; 264/126, 319

[56] References Cited

U.S. PATENT DOCUMENTS

| | | | |
|---|---|---|---|
| 1,789,477 | 1/1931 | Roseby . | |
| 1,850,181 | 3/1932 | Roseby | 148/104 |
| 2,232,352 | 2/1941 | Verweig et al. | 427/127 |
| 2,783,208 | 2/1957 | Katz | 148/105 |
| 2,888,738 | 6/1959 | Taylor | 75/254 |
| 3,766,096 | 10/1973 | Mastrongelo | 252/62.54 |
| 3,933,536 | 1/1976 | Doser et al. | 148/105 |
| 3,935,340 | 1/1976 | Yamaguchi et al. | 427/216 |
| 4,106,932 | 8/1978 | Blochford | 75/252 |
| 4,229,217 | 10/1980 | Hähn | 75/254 |
| 4,601,765 | 7/1986 | Soileau et al. | 75/234 X |
| 4,927,461 | 5/1990 | Ciloglu et al. | 75/246 |
| 4,927,473 | 5/1990 | Ochiai et al. | 75/230 X |
| 4,938,810 | 6/1990 | Kiyota et al. | 75/249 |
| 4,947,065 | 8/1990 | Ward et al. | 252/62.54 |
| 5,036,011 | 11/1991 | Rutz et al. | 252/62.54 |
| 5,051,218 | 9/1991 | Matthews | 264/56 |
| 5,069,714 | 12/1991 | Gusselin | 75/252 |
| 5,130,171 | 7/1992 | Prud'Homme et al. | 427/213 X |

*Primary Examiner*—Michael Lusignan

*Attorney, Agent, or Firm*—Woodcock Washburn Kurtz Mackiewicz & Norris

[57] ABSTRACT

An iron powder composition comprising an iron powder coated with a substantially uniform coating of a thermoplastic material and admixed with a boron nitride powder and a method of utilizing the mixture to produce a magnetic core component is provided. The iron powder mixture is formulated with up to about 1% by weight of boron nitride which reduces the stripping and sliding die ejection pressures during high temperature molding and also improves the permeability of the magnetic part over an extended frequency range.

9 Claims, 3 Drawing Sheets

THERMOPLASTIC COATED MAGNETIC POWDER COMPOSITIONS AND METHODS OF MAKING SAME

This is a division of application Ser. No. 701,776 filed May 17, 1991 now U.S. Pat. No. 5,198,137 patented Nov. 30, 1993, which is a continuation in part of application Ser. No. 365,186, filed Jun. 12, 1989, now U.S. Pat. No. 5,063,011.

FIELD OF THE INVENTION

The invention relates to iron-based powder compositions useful in molding magnetic components and methods of making thermoplastic-coated powder constituents of those compositions. It also relates to methods of making magnetic core components from the compositions which retain high permeability over an extended frequency range.

BACKGROUND OF THE INVENTION

The study of magnetic core components used in electrical/magnetic energy conversion devices such as generators and transformers requires analysis of several physical and electromagnetic properties for the core component. Two key characteristics of an iron core component are its magnetic permeability and core loss characteristics. The magnetic permeability of a material is an indication of its ability to become magnetized, or its ability to carry a magnetic flux. Permeability is defined as the ratio of the induced magnetic flux to the magnetizing force or field intensity. When a magnetic material is exposed to a rapidly varying field, a resultant energy loss in the core occurs. The core losses are commonly divided into two categories: hysteresis and eddy current losses. The hysteresis loss is brought about by the necessary expenditure of energy to overcome the retained magnetic forces within the iron core component. The eddy current loss is brought about by the production of electric currents in the iron core component due to the changing flux caused by alternating current (AC) conditions.

Early magnetic core components were made from laminated sheet steel, however, these components were unsatisfactory due to large core losses at higher frequencies and due to manufacturing difficulties. Application of these lamination-based cores is also limited by the necessity to carry magnetic flux only in the plane of the sheet in order to avoid excessive eddy current losses. Sintered metal powders have been used to replace the laminated steel as the material for the magnetic core component, but these sintered parts also have high core losses and are restricted primarily to direct current (DC) operations.

Research in the technology of magnetic core components has recently been centered around the use of unsintered iron-based powders which contain various coatings upon the iron powder particles. This research has strived to develop iron powder compositions which enhance certain physical and magnetic properties without detrimentally affecting other properties. Desired properties include a high permeability through an extended frequency range, high pressed strength, low core losses, and suitability for compression molding techniques.

When molding a core component for AC power applications, it is generally required that the iron particles have an electrically insulating coating to decrease core losses. The use of a plastic coating (see U.S. Pat. No. 3,935,340 to Yamaguchi) and the use of doubly-coated iron particles (see U.S. Pat. No. 4,601,765 to Soileau et al.) have been employed to insulate the iron particles and therefore reduce eddy current losses. However, these powder compositions require a high level of binder, resulting in decreased density of the pressed core part and, consequently, a decrease in permeability. Moreover, if the use of such iron powder mixtures in a compression molding operation requires heating the die, high stripping and sliding ejection pressures are generated in the absence of an appropriate lubricant. This results in increased die wear and scoring of the pressed component. The use of conventional die wall lubricants such as zinc stearate, which were effective at room temperature compression molding, are not useful at the higher temperature compression conditions required to generate resin flow necessary for the molding of coated powder compositions.

U.S. Pat. No. 4,927,473 to Ochiai et al discloses an iron-based powder composition whose particles are covered with an insulating layer of an inorganic powder such as boron nitride. These coated particles are used to form a magnetic core by compression molding techniques. The coated iron particles do not contain any outer coating or second coating of a thermoplastic resin, the absence of which, it has now been found, leads to lower core strength.

A need therefore exists in the art for an iron powder composition which is characterized by properties which include a high permeability through an extended frequency range, a relatively high pressed strength, reduced core losses, and reduced stripping and sliding ejection pressures when molded.

SUMMARY OF THE INVENTION

The present invention provides an iron-based powder composition that is particularly useful for forming magnetic components. The powder composition comprises iron core particles having a substantially uniform coating of thermoplastic materials surrounding the particles, where the thermoplastic material constitutes up to about 15% by weight of the coated particles, and a boron nitride powder admixed with the coated particles. In preferred embodiments, the thermoplastic material is either a polyethersulfone, polyetherimide, polycarbonate, polyphenylene or combinations thereof and the boron nitride powder is present in an amount up to about 1% by weight of the thermoplastic-coated particles.

The present invention also provides a method for molding the magnetic components. Broadly, the method involves placing the powder composition of the invention into a die and pressing the composition into the die at a temperature and pressure sufficient to form an integral core component. Generally the die is first heated to a temperature exceeding the glass transition temperature of the thermoplastic material. The magnetic components made by the compositions and methods of this invention are characterized by having high pressed strength, high permeability through an extended frequency range, and low core losses. Additionally, the compositions of this invention can be pressed to a relatively high density and exhibit low strip and slide ejection pressures, thereby lessening wear on the die and reducing scoring of the pressed part upon removal from the die.

The present invention also provides a method of producing thermoplastic-coated iron particles. The particles are fluidized in air and contacted with a solution of a thermoplastic material. Preferably, the process is operated under conditions that produce coated particles having an apparent density of from about 2.4 g/cm$^3$ to about 2.7 g/cm$^3$.

DETAILED DESCRIPTION OF PREFERRED EMBODIMENTS

Figure 1:
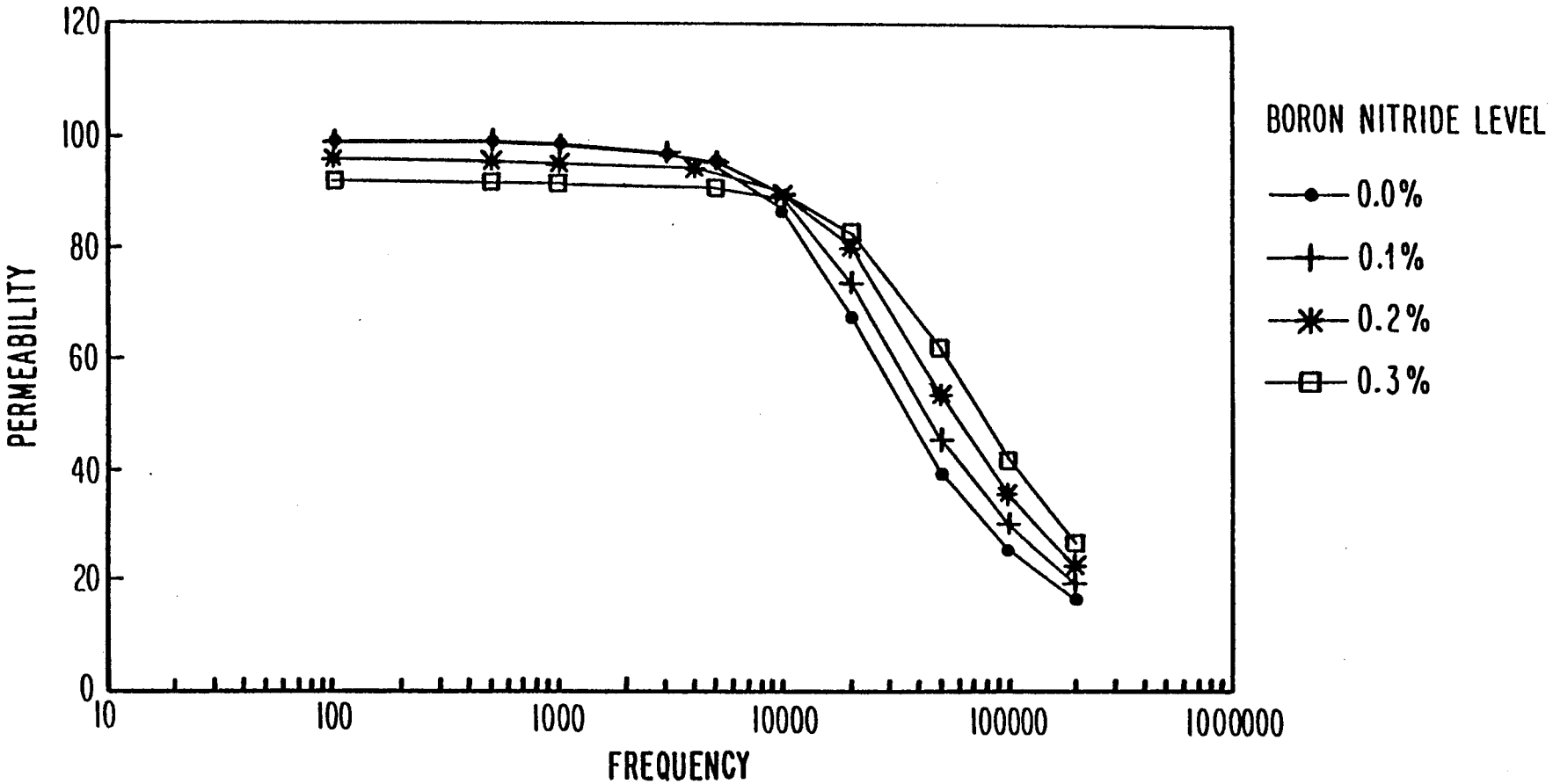
FIG. 1 depicts initial permeability as a function of frequency for a core component made from the powder composition of this invention having varying levels of boron nitride.

According to the present invention, an iron-based powder composition useful in the production of magnetic components is provided. The powder compositions of this invention comprise iron core particles coated with a thermoplastic binder, which coated powders are in admixture with boron nitride powder. The iron-based powder compositions provided in accordance with this invention are particularly useful for molding magnetic components for use in high switching frequency magnetic devices or in any magnetic core component in which low magnetic core losses are required.

The starting iron-based core particles are high-compressibility powders of iron or ferromagnetic material, preferably having a weight average particle size of about 10–200 microns. An example of such a powder is ANCORSTEEL 1000C powder, which is a powder of substantially pure iron having a typical screen profile of about 13% by weight of the particles below 325 mesh and about 17% by weight of the particles greater than 100 mesh with the remainder between these two sizes, available from Hoeganaes Corporation, Riverton, N.J. The ANCORSTEEL 1000C powder typically has an apparent density of from about 2.8 to about 3 g/cm$^3$.

The iron particles are coated with a thermoplastic material to provide a substantially uniform coating of the thermoplastic material. Preferably, each particle has a substantially uniform circumferential coating about the iron core particle. The coating can be applied by any method that uniformly coats the iron particles with the thermoplastic material. Sufficient thermoplastic material is used to provide a coating of about 0.001–15% by weight of the iron particles as coated. Generally the thermoplastic material is present in an amount of at least 0.2% by weight, preferably about 0.4–2% by weight, and more preferably about 0.6–0.9% by weight of the coated particles.

The use of iron-based powders having a thermoplastic coating as above described provides advantages such as improved pressed strength and the ability to mold magnetic components of complex shapes that have a constant magnetic permeability over a wide frequency range. A multitude of polymer coatings may be employed in the iron powder composition of the present invention. Any polymer system that is adequately non-crystalline to allow the polymer to be dissolved in an organic solvent and fluidized in a Wurster-type fluid bed coater is applicable. Preferred are those thermoplastics having a weight average molecular weight in the range of about 10,000 to 50,000. In preferred embodiments, the thermoplastic material is a polyethersulfone, a polyetherimide, a polycarbonate, or a polyphenylene ether.

Suitable polycarbonates which can be utilized as a thermoplastic in the present invention are bisphenol-A-polycarbonates, also known as poly(bisphenol-A-carbonate). These polycarbonates have a specific gravity range of about 1.2 to 1.6. A specific example is poly(oxycarbonyloxy-1,4-phenylene-(1-methylethlidene)-1,4-phenylene) having an empirical formula of $(C_{16}H_{14}O_3)_n$ where n =30 to 60. A commercially available polycarbonate is sold under the trademark LEXAN ® resin by General Electric Company. The most preferred LEXAN ® resins are the LEXAN ® 121 and 141 grades.

A suitable polyphenylene ether thermoplastic is poly(2,6-dimethyl-1,4-phenylene oxide) which has an empirical formula of $(C_8H_8O)_n$. The polyphenyleme ether homopolymer can be admixed with an alloying/blending resin such as a high impact polystyrene, such as poly(butadiene-styrene); and a polyamide, such as Nylon 66 either as polycaprolactam or poly(hexamethylenediamine-adipate). These thermoplastic materials have a specific gravity in the range of about 1.0 to 1.4. A commercially available polyphenylene is sold under the trademark NORYL ® resin by the General Electric Company. The most preferred NORYL ® resins are the NORYL ® 844, 888, and 1222 grades.

A suitable polyetherimide thermoplastic is poly[2,2'-bis(3,4-dicarboxyphenoxy) phenylpropane)-2-phenylene bismide] which has an empirical formula of $(C_{37}H_{24}O_6N_2)_n$ with n=15–27. The polyetherimide thermoplastics have a specific gravity in the range of about 1.2 to 1.6. A commercially available polyetherimide is sold under the trade name ULTEM ® resin by the General Electric Company. The most preferred ULTEM ® resin is the ULTEM ® 1000 grade.

A suitable polyethersulfone thermoplastic has a general empirical formula of $(C_{12}H_{16}SO_3)_n$. An example of a suitable polyethersulfone which is commercially available is sold under the trade name VICTREX PES ® by ICI, Inc. The most preferred VICTREX PES ® resin is the VICTREX PES ® 5200 grade.

In a preferred coating method, the coating is applied in a fluidized bed process, preferably with use of a Wurster coater such as manufactured by Glatt, Inc. During the Wurster coating process, the iron particles are fluidized in air. The thermoplastic material is dissolved in an appropriate organic solvent and the resulting solution is sprayed through an atomizing nozzle into the inner portion of the Wurster coater, where the solution contacts the fluidized bed of iron particles. Any organic solvent for the thermoplastic material can be used, but preferred solvents are methylene chloride and 1,1,2 trichloroethane. The concentration of thermoplastic material in the coating solution is preferably at least 3% and more preferably about 5–10% by weight. The use of a peristaltic pump to transport the thermoplastic solution to the nozzle is preferred. The fluidized iron particles are preferably heated to a temperature of at least about 25° C., more preferably at least about 30° C., but below the solvent boiling point, prior to the addition of the solution of thermoplastic material. The iron particles are wetted by the droplets of dissolved thermoplastic, and the wetted particles are then transferred into an expansion chamber in which the solvent is removed from the particles by evaporation, leaving a uniform coating of thermoplastic material around the iron core particles.

The amount of thermoplastic material coated onto the iron particles can be monitored by various means. One method of monitoring the thermoplastic coating process is to operate the coater in a batch-wise fashion and administer the amount of thermoplastic necessary for the desired coating percentage at a constant rate during the batch cycle, with a known amount of thermoplastic in the solution being used. Another method is to constantly sample the coated particles within the fluidized bed for carbon content and correlate this to a thermopastic coating content.

This process provides iron powders with a substantially uniform circumferential coating of thermoplastic material. The final physical characteristics of the coated particles can be varied by manipulation of different operating parameters during the coating process.

A preferred thermoplastic-coated iron particle is characterized by having an apparent density from about 2.4 g/cm$^3$ to about 2.7 g/cm$^3$ and a thermoplastic coating that constitutes about 0.4–2.0% by weight of the particles as coated. It has been found that components made from particles within these limits exhibit superior magnetic properties.

A preferred process for the production of the thermoplastic coated particles employs a Glatt GPCG-5 Wurster coater having a 17.8 cm (7 in.) coating insert. In one specific example, a 17 kg (37.5 lb.) load of ANCORSTEEL A1000C iron powder (from Hoeganaes Co.) having an apparent density of about 3.0 g/cm$^3$ is charged into the coater. This powder is fluidized and brought to a process temperature of about from 33°–37° C., preferably 35° C. A solvent is sprayed into the coater to clean out the nozzle assembly. A 7.5 weight percent solution of ULTEM ® resin 1000 grade polyetherimide in methylene chloride is sprayed into the coater via a peristaltic pump at a rate of about 110–120 grams per minute. The solution is atomized through a 1.2 mm nozzle at the bottom of the coater with a 4 bar atomizing pressure. The coater is operated at a 40% air flap setting with an "A" plate with an inlet air temperature from about 35°–40° C. The process continues until about 1,700 g (3.75 lb) of solution are sprayed into the coater. The solution addition is then stopped, but the coated powder is maintained in a fluidized state until the solvent evaporates. The final coated powder has a thermoplastic content of about 0.75% by weight.

In the preparation of the powder composition of the present invention, the thermoplastic-coated iron particles are admixed with boron nitride powder in an amount up to about 1%, preferably about 0.05–0.4%, by total weight of the thermoplastic coated particles. The boron nitride powder particles preferably have a weight average particle size below about 20 microns, and more preferably below about 10 microns, with a maximum particle size no greater than about 100 microns, preferably no greater than about 60 microns. The boron nitride employed in the present invention preferably has a hexagonal crystalline structure. The cubic structure of boron nitride, although it has advantageous strength properties, is less preferred for use in the invention since it does not provide as much lubricity as the hexagonal structure. A suitable boron nitride powder is available from Union Carbide as HCV grade boron nitride having a particle size range of about 1 to 60 microns and an average particle size of about 4 microns. The boron nitride powder is combined with the coated iron particles by standard mechanical mixing processes known in the powder mixing art.

The admixture of thermoplastic coated iron powder with boron nitride as described can be formed into magnetic cores by an appropriate molding technique. In preferred embodiments, a compression molding technique, utilizing a die heated to a temperature above the glass transition temperature of the thermoplastic material, is used to form the magnetic components. A temperature of at least 475° F., and preferably over 500° F., is employed when the thermoplastic material is either a polyethersulfone or a polyetherimide. The mixture is charged into the die, and normal powder metallurgy pressures are applied to press out the desired component. It is noted that at the high die temperatures employed, necessary to ensure proper thermoplastic flow and subsequent component pressed strength, usual low temperature die lubricants such as zinc stearate are not useful. Typical compression molding techniques employ compression pressures of from about 5 to 200 tons per square inch (tsi) and more preferably in the range of about 30 to 60 tsi. The temperature and pressures used in the pressure molding step are generally those that will be sufficient to form a strong integral part from the powder composition. The presence of boron nitride as a lubricant permits the compression step to be performed at high temperatures with reduced stripping and sliding ejection pressures.

The effects of the addition of various amounts of boron nitride (BN) on the properties of thermoplastic coated iron particles and compacts made therefrom were studied. The iron particle source used was ANCORSTEEL A1000C (average particle size 75 microns) with a 0.75% by total weight coating of ULTEM ® resin 1000 grade polyetherimide, applied in a Wurster coater as earlier described. Transverse rupture strength (TRS) was tested on bars which were pressed at 30, 40, and 50 tons per square inch (tsi). The bars were 1.25 inches in length, 0.5 inches in width, and 0.25 inches in height. The magnetic properties were studied using toroids compacted at 50 tsi. All pressing was conducted at a temperature of 525° F. The toroids were wrapped with 70 primary and 70 secondary turns of #28 AWG wire.

Table 1 shows that the addition of BN to the thermoplastic coated particles increases the flow rate of the composition most significantly at BN levels of about 0.1–0.2%. The apparent density of the BN-containing composition demonstrates the greatest increase at the same BN levels.

TABLE 1

Apparent Density and Flow of Iron Powder Coated with 0.75% Ultem Admixed With Boron Nitride

| BN content (wt. %) | Apparent Density (g/cc) | Flow sec/50 g |
|---|---|---|
| 0.0 (control) | 2.68 | 29.2 |
| 0.1 | 3.01 | 25.6 |
| 0.2 | 3.01 | 25.9 |
| 0.3 | 2.95 | 26.9 |

TABLE 2

Other Physical Properties of A1000C Iron Powder Coated With 0.75% Ultem Admixed With Boron Nitride

| BN (wt %) | Compaction Pressure (tsi) | Strip (psi) Pressure | Slide (psi) Pressure | Transverse Rupture Strength (psi) | Pressed Density (g/cm$^3$) | % Theor. Density |
|---|---|---|---|---|---|---|
| 0.0 (ref.) | 50 | 6,450 | 5,680 | 18,960 | 7.391 | 96.4 |
| | 40 | — | — | 19,967 | 7.316 | 96.6 |
| | 30 | — | — | 17,655 | 7.114 | 93.9 |
| 0.1 | 50 | 5,550 | 4,800 | 18,730 | 7.377 | 97.6 |
| | 40 | — | — | 17,746 | 7.315 | 96.8 |
| | 30 | — | — | 14,987 | 7.112 | 94.1 |
| 0.2 | 50 | 4,810 | 4,230 | 18,070 | 7.357 | 97.6 |
| | 40 | — | — | 16,583 | 7.296 | 96.8 |
| | 30 | — | — | 14,782 | 7.106 | 94.3 |
| 0.3 | 50 | 3,740 | 3,040 | 17,390 | 7.337 | 97.6 |
| | 40 | — | — | 15,638 | 7.273 | 96.7 |
| | 30 | — | — | 14,843 | 7.104 | 94.5 |

The properties after compression at 30, 40, and 50 tsi were also studied. A dramatic effect of the BN addition is shown in Table 2. Both the stripping and sliding ejection pressures are reduced upon the addition of the BN, a significant benefit in that wear on the die and scoring of the pressed components will be substantially reduced. The strip and slide pressures are measured as follows. After the compaction step, one of the punches is removed from the die, and pressure is placed on the second punch in order to push the part from the die The load necessary to initiate movement of the part is recorded. Once the part begins to move, the part is pushed rom the die at a rate of 0.10 cm (0.04 in.) per second. The load applied after five seconds (after the part is moved 0.5 cm, 0.2 in.) is also recorded. The measurement is preferably performed at the same press speed and time so that the part is always in the same area of the die cavity. These loads are then converted into a pressure by dividing by the area of the part in contact with the die body. The stripping pressure is the pressure for the process at the point where movement is initiated. The sliding pressure is the pressure for the process at the five second point.

The strength was determined by using the formula for transverse rupture strength found in Materials Standards for PM Structured Parts, Standard 41, published by Metal Powder Industry Federation (1990–91 Ed.). The higher the amount of BN added, the lower the resulting strength. However, at lower BN levels and at higher compaction pressures, the pressed strength approaches that of the reference mixture.

Table 2 also shows the effect of the BN on the pressed density. The density drops off with increased levels of BN as is expected due to the lower density (2.2 g/cm$^3$) of the BN as compared to iron. The percentage of theoretical density of the compressed components is also shown in Table 2. The effects of the BN additive on the theoretical density are most significant at lower compaction pressures. This illustrates that internal lubrication is achieved at the lower pressures, and at the higher pressures the internal lubrication is less significant. The higher percentage of theoretical density at lower compaction pressures for the BN additive mixtures is beneficial in that lower compaction pressures allow for the same component density to be achieved with less wear on the die.

Figure 2:
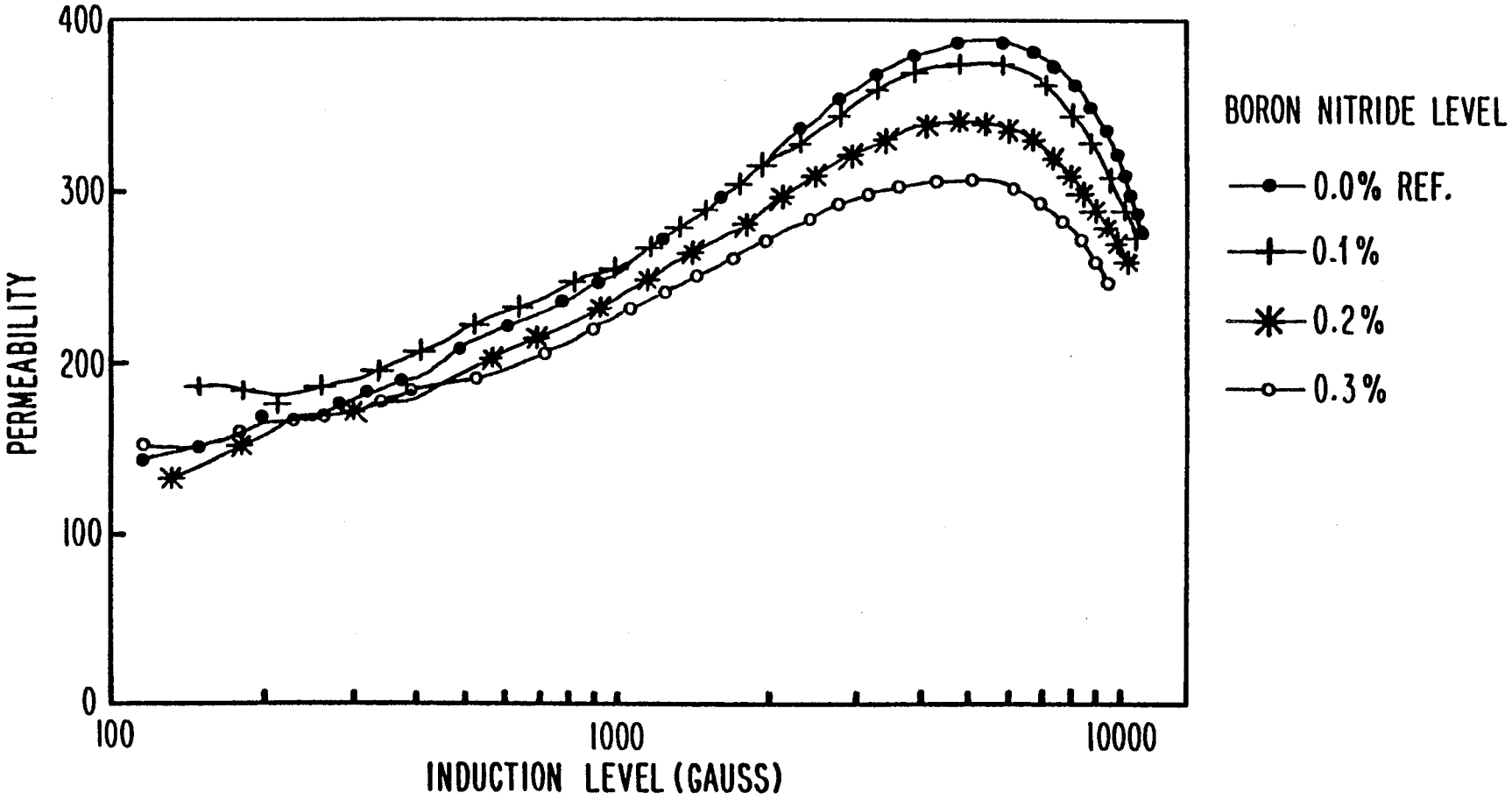
FIG. 2 depicts the permeability, as a function of induction level, of a core component made of powders of the present invention having varying levels of boron nitride.
Figure 3:
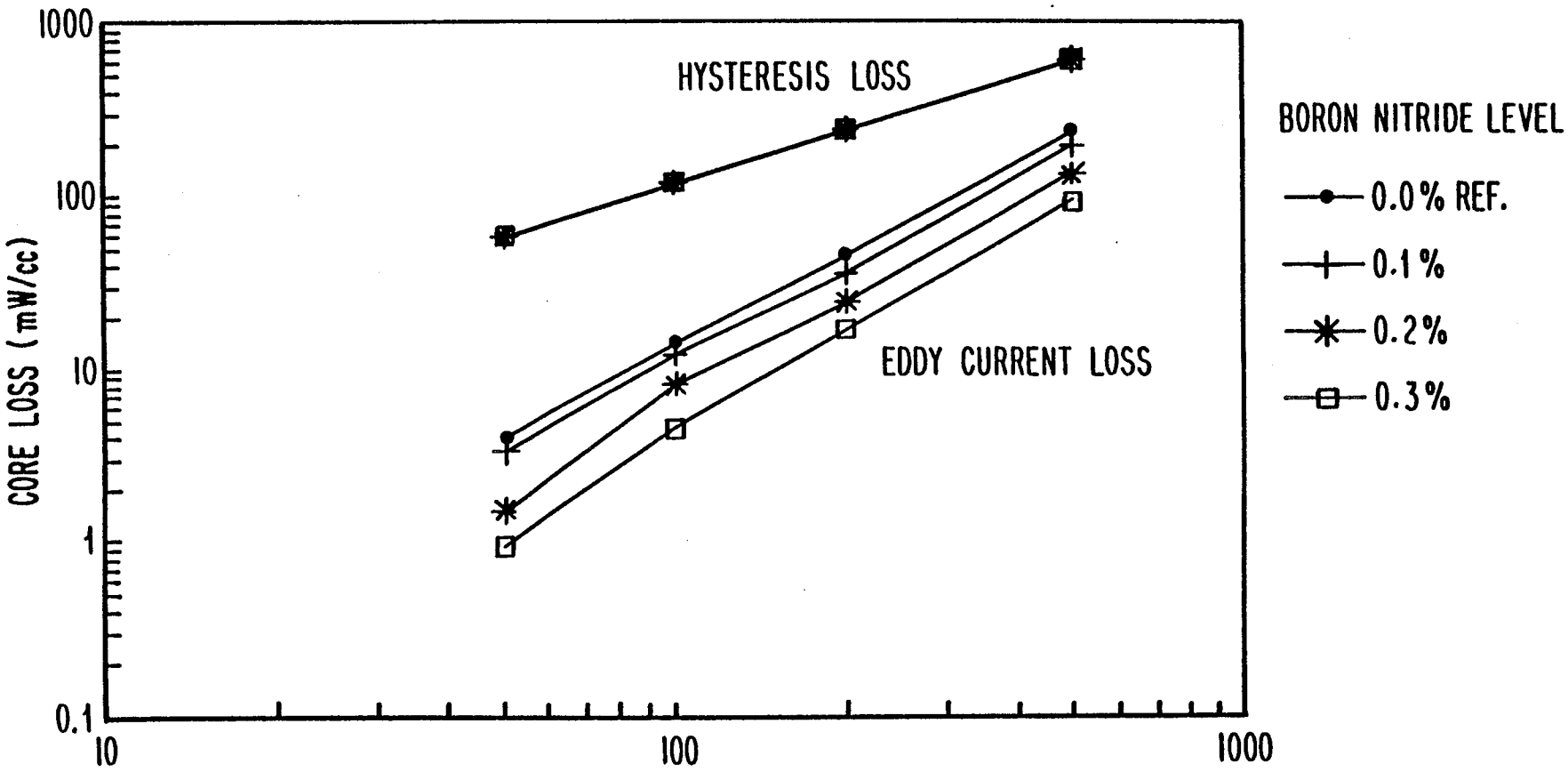
FIG. 3 depicts the core loss as a function of frequency for a core component made from powder compositions of this invention having varying levels of boron nitride.

The magnetic properties of the BN additive mixtures are shown in FIGS. 1–3. FIG. 1 shows the permeability as a function of frequency at 10 Gauss. Since the BN is nonmagnetic, the resulting AC permeability is slightly decreased at lower frequencies as the BN level is increased. However, at higher frequencies, the resistivity characteristics of the BN additive enhance the permeability of the component. This is due largely in part to the decrease in eddy current losses as further illustrated in FIG. 3.

The DC permeability as a function of induction level and BN content is shown in FIG. 2. The DC permeability decreases with increasing levels of BN, due largely to the decrease in pressed component density.

The AC loop analysis indicated significant reduction in core loss due to the addition of the BN additive. This overall core loss is broken down into both hysteresis loop area and eddy current loss in FIG. 3. The hysteresis loss remains relatively constant with increasing levels of BN. However, a significant reduction in eddy current losses is seen for increasing levels of BN. Although not shown in the FIG. 3 graph, at higher operating frequencies the permeabilities are the highest and the core losses the lowest for the higher BN level components. The significance of the reduced core loss and corresponding reduction in eddy current losses brought about by the increased level of BN is a dominant feature at higher frequencies where eddy current losses outweigh hysteresis losses.

What is claimed:

1. A method of making a magnetic core component comprising;

providing an iron-based powder composition comprising;

iron core particles having a substantially uniform coating of a thermoplastic material surrounding the iron particles, said thermoplastic material constituting from about 0.2% to about 15% by weight of the iron particles as coated; and boron nitride powder admixed with said coated particles in an amount up to about 1% by weight of the coated particles; and pressing the composition in a die at a temperature and pressure sufficient to form an integral core component.

2. The method of claim 1 wherein the boron nitride is present in an amount of about 0.05–0.4% by weight of the coated particles.

3. The method of claim 2 wherein the thermoplastic material constitutes from about 0.4–2.0% by weight of the coated particles and the coated particles have an apparent density of from about 2.4 g/cm$^3$ to about 2.7 g/cm$^3$.

4. The method of claim 1 wherein the thermoplastic material constitutes about 0.6–0.9% by weight of the iron particles.

5. The method of claim 1 wherein the thermoplastic material is selected from the group consisting of polyethersulfone, polyetherimide, polycarbonate, polyphenylene ether and combinations thereof.

6. The method of claim 5 wherein the iron core powder has a weight average particle size of about 10–200 microns.

7. The method of claim 2 wherein the pressing step is part of a compression molding process.

8. The method of claim 2 wherein the compression molding process comprises the steps of;

heating the die to a temperature above the glass transition temperature of the thermoplastic material; and applying a pressure of about 5–200 tsi to the composition in the die.

9. The method of claim 8 wherein the compression pressure is below about 50 tsi, producing a stripping pressure below about 5,750 psi and a sliding pressure below about 5,000 psi.

* * * * *